United States Patent [19]

Clark

[11] 4,187,918

[45] Feb. 12, 1980

[54] DOWN-HOLE EARTH DRILLING MOTOR CAPABLE OF FREE CIRCULATION

[76] Inventor: Wallace Clark, 1830 S. German Church Rd., Indianapolis, Ind. 46239

[21] Appl. No.: 914,776

[22] Filed: Jun. 12, 1978

[51] Int. Cl.[2] ..... E21B 13/00; E21B 1/06

[52] U.S. Cl. ..... 175/39; 175/107; 415/502; 418/48

[58] Field of Search ..... 175/101, 106, 107, 39; 173/13, 14; 415/502; 418/48

[56] References Cited

U.S. PATENT DOCUMENTS

| | | | |
|---|---|---|---|
| 1,727,267 | 9/1929 | Diehl | 175/101 |
| 2,553,548 | 5/1951 | Canazzi et al. | 418/48 X |
| 2,967,577 | 1/1961 | Tiraspolsky | 175/107 |
| 3,159,222 | 12/1964 | Hammer et al. | 175/107 |
| 3,661,218 | 5/1972 | Brown | 175/107 |
| 3,912,426 | 10/1975 | Tschirky | 418/48 |
| 3,951,219 | 4/1976 | Cortes | 175/107 |
| 4,019,592 | 4/1977 | Fox | 175/107 |
| 4,059,165 | 11/1977 | Clark | 175/107 |

*Primary Examiner*—James A. Leppink
*Assistant Examiner*—Richard E. Favreau
*Attorney, Agent, or Firm*—Frost & Jacobs

[57] ABSTRACT

There is disclosed a down-hole drilling motor having a connection to the drill bit, such that, when desirable or necessary, fluid may be circulated in the bore by means of the motor to clean out undue accumulation of cuttings, or for other reasons, while at the same time the bit is stopped, thereby saving wear on the bit and bit drive parts. When the motor is disconnected from the drill shaft, the drill shaft may be locked to the drill pipe so that the bit may be rotated by turning the drill pipe from the top of the bore with the conventional rotary table to permit the operator to drill his way out if the drill is stuck or to roll the bit out from under a ledge under which it might be caught during drilling.

12 Claims, 9 Drawing Figures

DOWN-HOLE EARTH DRILLING MOTOR CAPABLE OF FREE CIRCULATION

CROSS REFERENCE TO RELATED APPLICATION

This application is related to an application in the names of Clark and Goldstein, Ser. No. 878,814 filed Feb. 17, 1978 entitled "Motor Transmission Construction".

BRIEF SUMMARY OF THE INVENTION

In said copending application there is taught a transmission which can replace the conventional connecting rod and double universal joint, where it is necessary to transmit the torque from an element which gyrates about an axis while rotating, to an element which rotates on true centers. That transmission is particularly useful in connection with progressing cavity type pumps or motors, based on principles first disclosed by R. J. L. Moineau in his early patent, e.g. U.S. Pat. No. 1,892,217 of Dec. 27, 1932.

A forerunner of said copending Clark and Goldstein application involved a radial arm non-rotatably secured at one of its ends to the inner member of a helical gear pair, and fixed means to limit the other end of the radial arm to reciprocatory and oscillatory motion. Reference may be had to U.S. Pat. No. 3,932,072 issued Jan. 13, 1976 in the name of Wallace Clark. A later U.S. Pat. No. 3,951,097, dated Apr. 20, 1976 in the name of Wallace Clark, made use of the ball and tube disclosed in U.S. Pat. No. 3,932,072 in connection with water swivels. The principles disclosed in the above mentioned patents were carried forward in U.S. Pat. No. 4,059,165 dated Nov. 22, 1977 in the name of Wallace Clark. Among other things, the last mentioned patent disclosed the substitution of a pair of parallel axial cheeks for the radial tube, so that the various elements could be disassembled axially which was impossible with the ball and tube construction.

The present invention makes use of a ball and half-tube as disclosed in said copending application in the names of Clark and Goldstein, and provides additionally a plate secured to the tail end of the inner helical gear member to bear against the end of the outer member, and thus allow the drill string to be raised an amount sufficient to withdraw the ball from between the cheeks or from the half-tube. The plate at the tail end of the inner helical member prevents it from falling down, and causes it to be withdrawn with the drill string. Then the circulating fluid (which may be drilling mud) can continue to drive the helical gear motor freely (in neutral, so to speak) while the drill bit and its associated parts rest on the bottom of the bore, or suspended anywhere, without rotating. When the drill string is raised as above outlined it may be caused to interlock with the drill shaft so that by rotating the drill string by means of the rotary table at the top of the hole the bit may be caused to rotate in order to free it from an obstruction with which it may have become engaged in the hole, without driving the motor by means of drilling mud.

DETAILED DESCRIPTION

Figure 1:
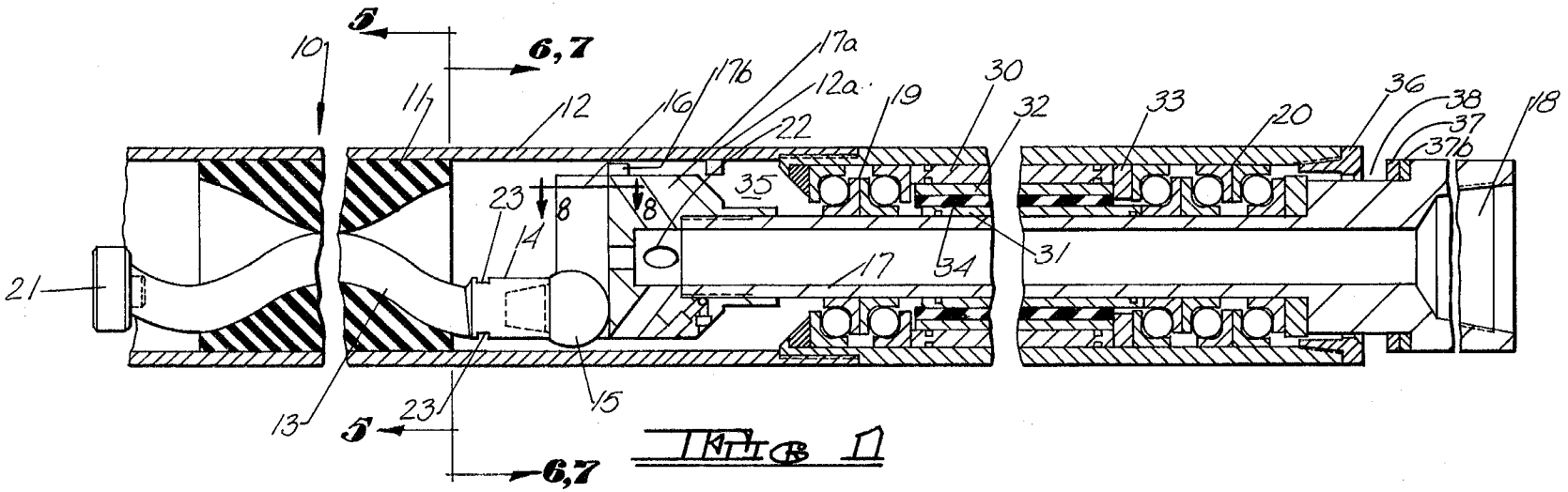
FIG. 1 is a longitudinal cross sectional view through a drilling motor, shortened in length by breaking out non-essential portions, in the drilling mode.

Referring to FIG. 1, the down-hole motor is generally indicated at 10. It will be understood that it is very much longer than shown in the drawings but since the motor, per se, does not form any part of the invention, it has been shortened by breaking out a large portion thereof. The outer helical gear element is indicated at 11 and is secured inside the drill pipe 12. The inner helical gear member 13 is provided with the extension 14 and ball 15 disposed on the lathe axis of the member 13 as disclosed in said copending application. The ball 15 engages between a pair of parallel cheeks 16 and thereby when the motor 10 is operating, produces rotation of the hollow shaft 17 to which the drill bit is ultimately secured at the bit box 18. The shaft 17 is provided with the bearings at 19 and 20 which serve as both radial and thrust bearings, and which comprise a water swivel.

Between the bearings 19 and 20 there is provided a slidable sleeve 30; and between the sleeve 30 and a slidable sleeve 31 there may be provided a rubber radial bearing 34 with housing 32, similar to a conventional marine bearing. An annulus 33 serves as a flow restrictor and the amount of restriction is determined by the inside diameter of the member 33. The clearance should be such as to allow for small flow (say 5% to 15% of the total down-hole flow) for lubrication of the bearings. It should be noted that the sleeve 31 must not fill the entire space between the bearings 19 and 20, because room must be allowed for these bearings to approach each other as they wear.

Secured to the tail end of the inner helical gear member 13 is a support plate 21.

It will be observed that there are passages, one of which is indicated at 22, through which drilling mud may pass from the motor 10 through the hollow shaft 17 to provide drilling mud for the bit which is secured at 18.

If it is desired for any reason to clean out the bore, add to the density of the mud in it, or flush the hole while remaining in the hole, it is possible to declutch (so to speak) the motor from the drill bit as follows. The drill string 12 is withdrawn upwardly until the member 21 abuts the end of the outer helical gear member 11 and thereby withdraws the inner member 13 and the ball 15 to the point where the ball 15 no longer engages between the cheeks 16.

In this state, the motor can continue to run but the shaft 17 and drill bit will simply rest motionless on the bottom, or anywhere, being supported by the bearings, thereby saving wear and tear on the drill bit as well as on the bearings and associated parts.

Figure 2:
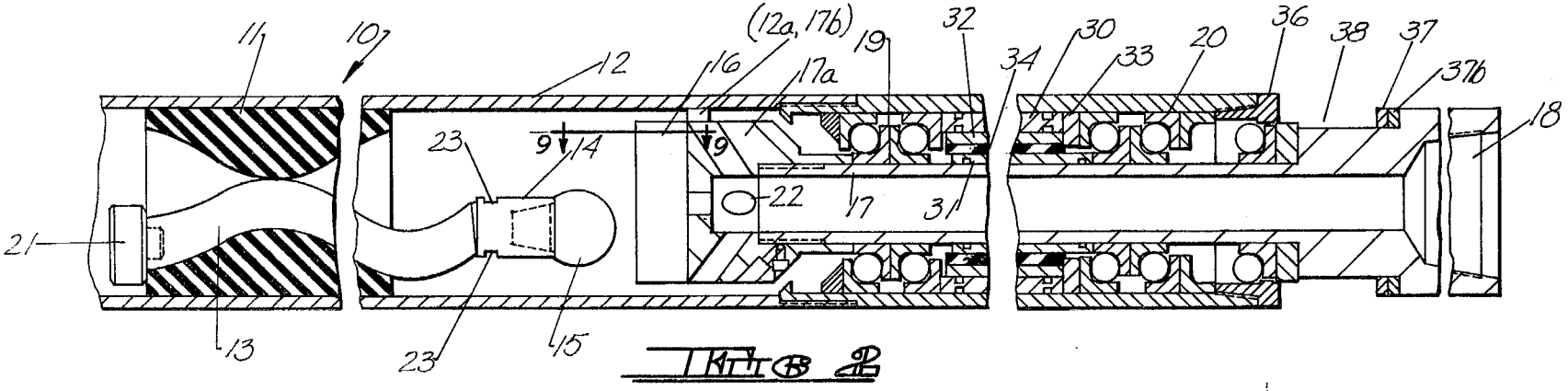
FIG. 2 is a view similar to FIG. 1 showing the device in free circulation mode.

Comparing FIGS. 1 and 2, it will be seen that the gap 35 in the drilling mode of FIG. 1, is relatively large, and that there is a small gap 38 between the members 36 and 37 of about the amount of ball and race wear which reasonably can be tolerated. In the idling mode of FIG. 2, the gap 35 is reduced in size, and a greater gap 38 now appears between the members 36 and 37. The member **37*b* may have a well known brake lining 37 secured on top of it and, with the bit box 18 serves as a brake in cooperation with the retaining nut 36. Ratchet-like teeth may be provided on the opposed faces of the members 18 and 37*b*, or any other well known means may be provided to keep these two metal parts from sliding on each other, such as countersunk bolts passing through 37 and 37*b* into 18. The main force in holding these members against relative rotation will be the weight of the drill stem which is transmitted to the retaining nut 36 and thence to the members 37, 37*b* and 18**.

The member **37*b* with lining 37 may be referred to as a brake, and it is spaced from the retaining nut (in the drilling mode) by an amount of bearing wear which the operator wishes to tolerate. By virtue of this structure, the operator will receive a signal while drilling, by virtue of a pressure rise at the mudpump. This pressure rise gives the operator sufficient notice of bearing wear so that he can stop the operation. If drilling continues after this warning signal, the digging into each other of the retaining nut 36 and brake lining 37** will cause the motor to stall, so that the bearings will not be worn out beyond a safe point. If at this point the operator raises the assembly out of the hole and renews the races and balls, he avoids having the bearing come apart and being lost in the hole, which would necessitate an expensive job of fishing out the parts before drilling could be restarted.

Figure 5:
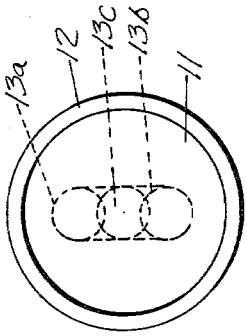
FIG. 5 is a cross sectional view through the helical gear pair showing the stator cross section of the helical gear pair and the rotor cross section in its two extreme positions as well as its center position, at that particular cross section.

It will be noted that the driving member **17*a* which is secured to the shaft 17 is provided with one or more lugs 17*b* and that the member 12 is provided with a like number of lugs 12*a*. The space between these lugs is such that when the drill string is raised to the position of FIG. 2, the lugs 12*a* and 17*a* will interengage. Thus, the drill will no longer be driven by the motor 10 but at the same time if the drill bit is stuck or wedged under an overhanging ledge or the like, the drill string may be rotated by means of the conventional rotary table at the top of the hole whereby the operator can drill his way out or roll the bit out from under a ledge from which it might be caught. This situation is shown in FIG. 2. FIG. 5 may be thought of as looking in the direction of the arrows 5—5 in FIG. 1**.

The relationship of the parts in cross section through the motor is shown best in FIG. 5. In this Figure, the drill pipe is indicated at 12 and the outer helical gear member at 11. The elongated oval on the vertical axis represents the bore in a particular cross section of the outer helical gear member and three positions of the inner member are indicated at **13*a*, 13*b* and 13*c*. The positions 13*a* and 13*b* indicate the two extreme positions of the inner helical gear member in a particular cross section and the circle 13*c*** indicates the central position.

Figure 3:
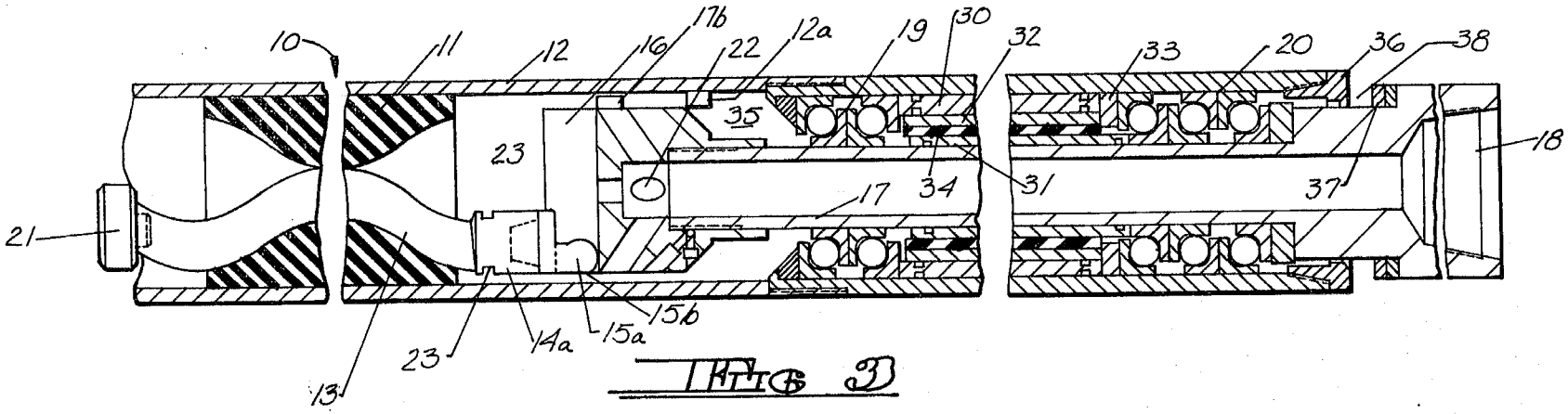
FIG. 3 is a view similar to FIG. 1 showing a slightly different embodiment.
Figure 4:
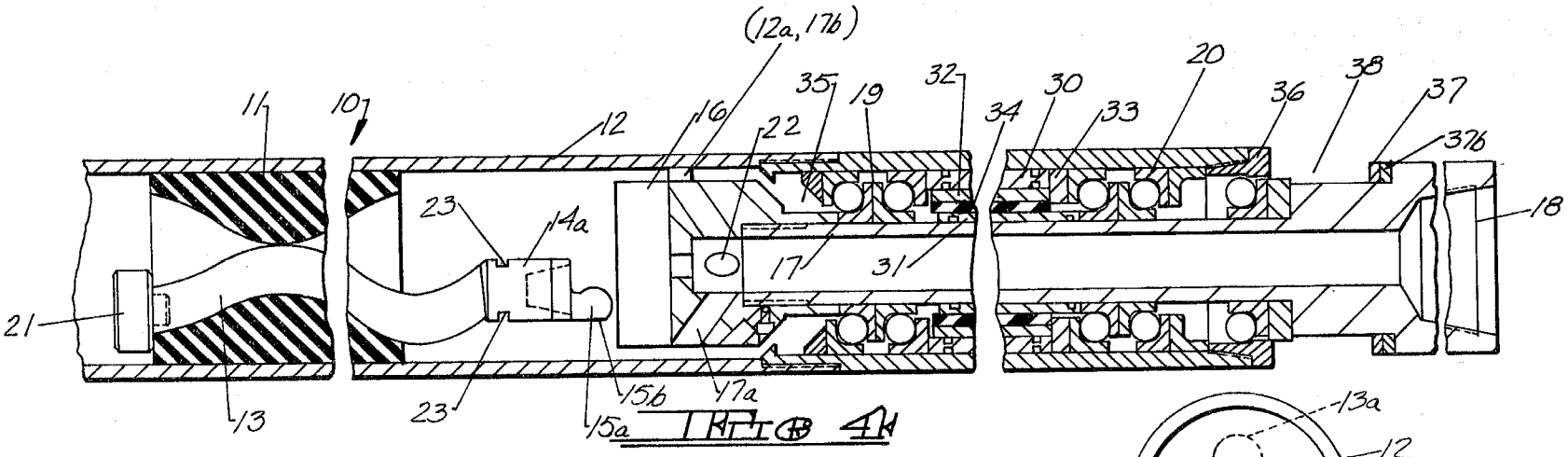
FIG. 4 is a view similar to FIG. 3 showing the device of FIG. 3 in the free circulation mode.

The embodiments disclosed in FIGS. 3 and 4 differs from that of FIGS. 1 and 2 only in the location of the ball which in FIGS. 3 and 4 is designated at **15*a*. Whereas in the embodiment of FIGS. 1 and 2 the ball is on the lathe axis of the inner member 13, in FIGS. 3 and 4 the ball is offset from the lathe axis and is therefore at a greater eccentricity. The operation of the arrangement is the same in both cases, however, except that the ball does not rotate but oscillates with relation to the half tube or cheeks, and also reciprocates. Other parts of the embodiment of FIGS. 3 and 4 which are the same as those of FIGS. 1 and 2, have been designated by the same reference numerals. The rotor head which is indicated at 14 in FIGS. 1 and 2 has been indicated at 14*a* in FIGS. 3 and 4. In each case the rotor head may be provided with the wrench flats 23** to facilitate assembly.

It may also be pointed out that the hanger plate bearing 21 is preferably mounted in the center of the inner member cross section rather than on the lathe center, thereby making it possible for the member 21 mounting hole in the inner member to be considerably larger than it could be if it were mounted on the lathe center of the inner member, due to the gear shape of the inner one of the gear pair. By being mounted on the center of the inner member cross section, there is provided a substantial amount of over-hang on the end of the outer member.

It should be noted that by virtue of the peculiar motion of the inner helical gear member with respect to the outer helical gear member, the ball in FIGS. 3 and 4 never crosses the centerline of the half-tube or cheeks, if its arm length perpendicular to the motor axis is equal to or greater than the eccentricity of the rotor, as will be described in connection with FIG. 7. It is also true of the embodiment of FIGS. 1 and 2 as to not crossing the center, which will be described in connection with FIG. 6. When the ball is withdrawn from between the cheeks or from the half-tube, and is later caused to re-enter the half-tube or cheeks, there is a fifty percent chance of changing the location of the ball to the other half of the half-tube or cheeks. In this way, wear on the half-tube or cheeks is effectively halved.

Figure 6:
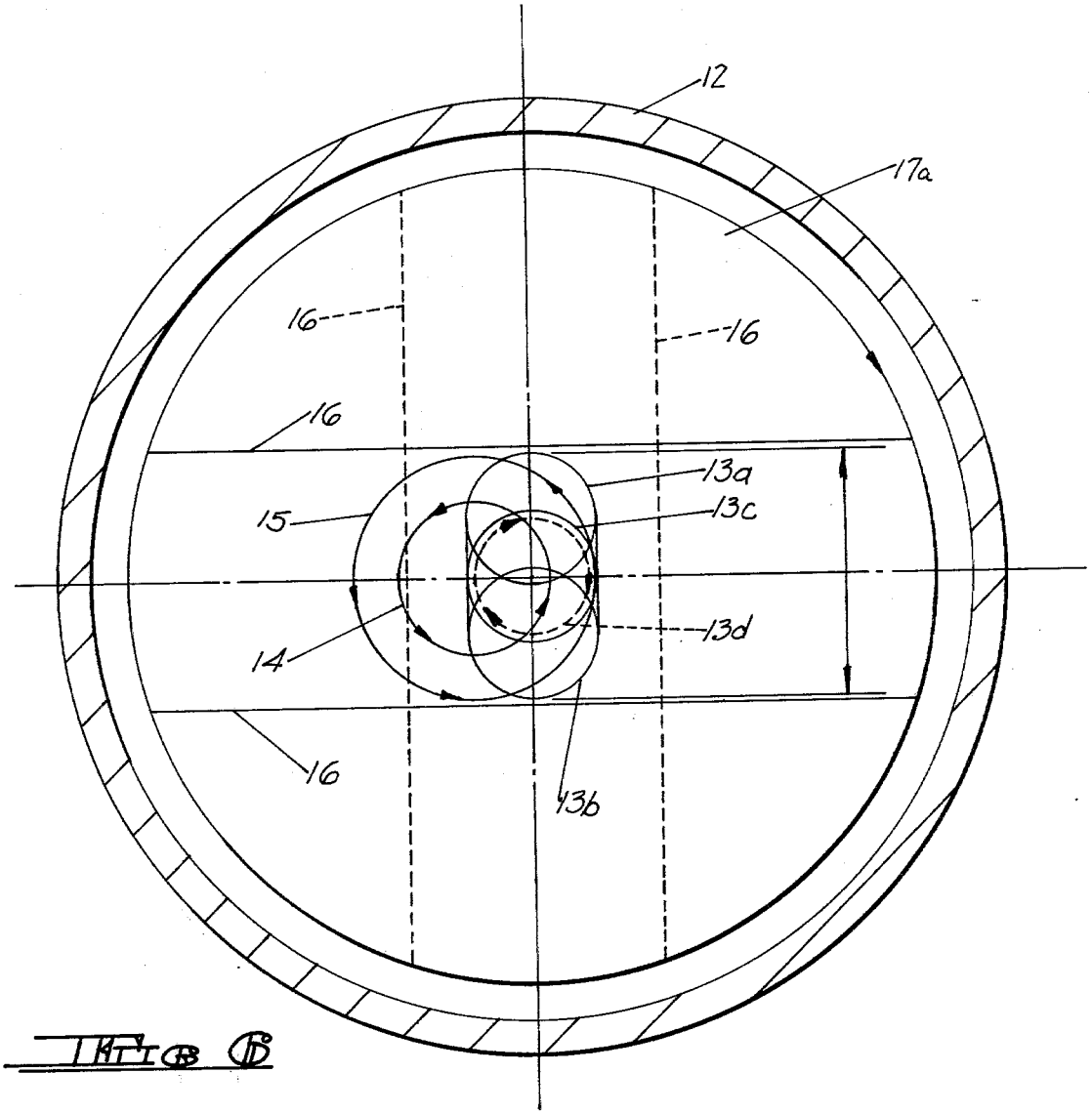
FIG. 6 is a diagrammatic representation of the relationship between the rotor cross section and the rotor head and showing the path of the rotor head and its relationship to the cheeks against which it exerts a driving force. The diagram of FIG. 6 relates to the embodiment of FIGS. 1 and 2.

FIG. 6 diagrammatically illustrates the relationship of parts and their relative movement during operation in the embodiment of FIGS. 1 and 2. It may be considered as viewed in the direction of the arrows 6—6 in FIG. 1. The rotor cross section is indicated at **13*a*, 13*b* and 13*c* just at it was in FIG. 5. The rotor head is indicated at 14 and the ball head is indicated at 15. The center of the rotor head path, and also incidentally of the ball path, is indicated by the broken line circle 13*d*. The arrows indicate the direction of rotation of the various parts. Thus, the rotor head and ball center rotate in a clockwise direction while the rotor head itself and the ball rotate in a counterclockwise direction during the clockwise rotation of their center. The cheeks against which the ball drives are indicated in one position at 16, 16** and in broken lines by the same reference numerals.

It should be noted that the rotor diameter is slightly larger than two times the eccentricity which is the radius of the circular path 13*d*.

From a study of FIG. 6, it will be clear that the center of the ball will never cross the centerline of the cheeks but will travel entirely on one side of the cheeks. Thus, when the unit is uncoupled as described above and later recoupled, the chances are 50/50 that the ball will be on the other side of the cheeks and thus the wear of the cheeks is distributed more evenly.

Figure 7:
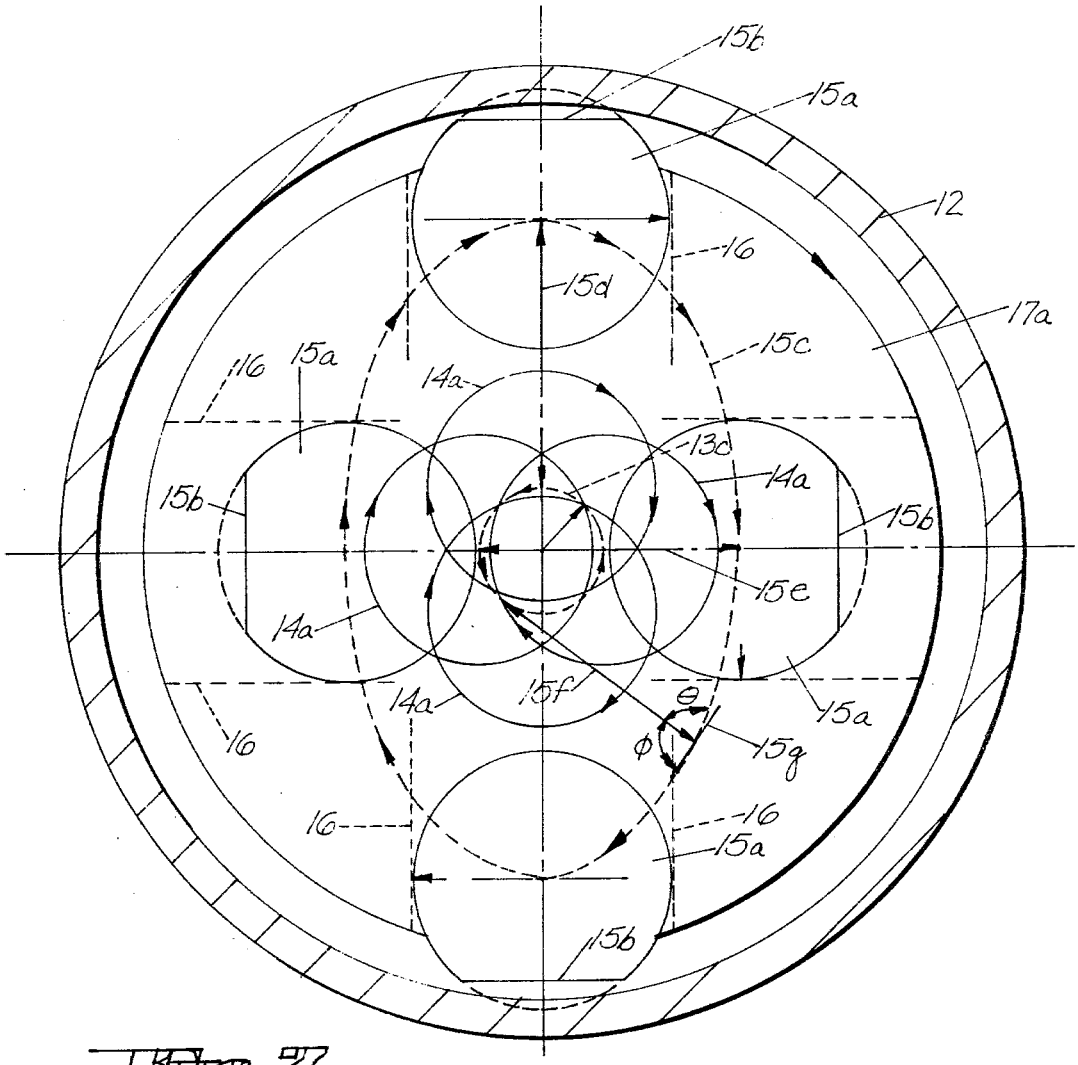
FIG. 7 is a diagrammatic representation of the relationship of the various parts in the embodiment of FIGS. 3 and 4.
Figure 8:
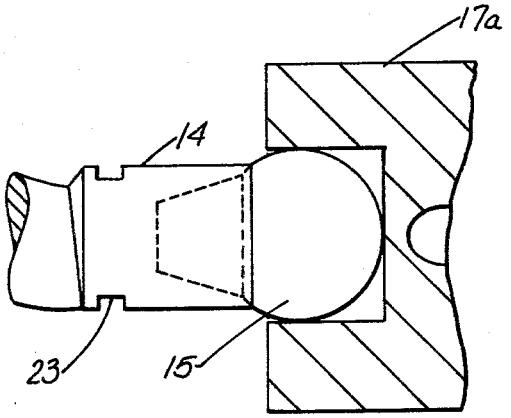
FIG. 8 is a fragmentary cross sectional view taken on the line 8—8 of FIG. 1.
Figure 9:
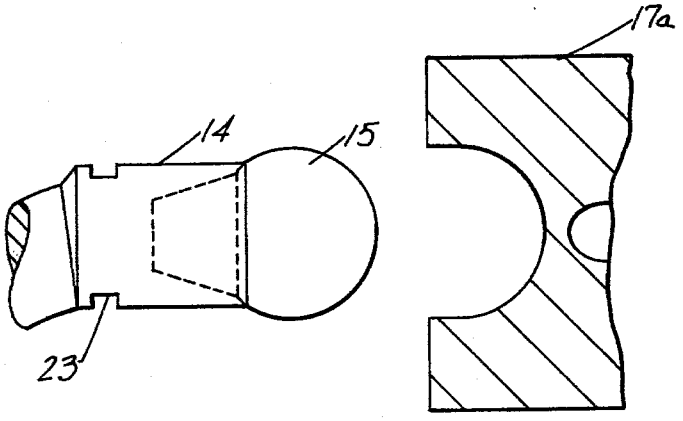
FIG. 9 is a fragmentary cross sectional view taken on the line 9—9 of FIG. 2.

Turning now to FIG. 7, this diagram represents the relationship and rotational directions of the various parts in the embodiment of FIGS. 3 and 4. It will be recalled that in the embodiment of FIGS. 3 and 4 the ball is offset from the rotor head. In this Figure the ball is shown in four positions and bears the reference numeral 15*a* as it does in FIGS. 3 and 4. The broken line ellipse shows the path of the center of the ball. Again, the rotor eccentricity is indicated by the radius of the small broken line circle 13*c* which describes the center of the path of the rotor head. Four positions of the rotor head are indicated at 14*a*. It will be noted that the rotor head center path moves counterclockwise while the rotor head itself rotates clockwise. The heavy line 15*d* represents the ball offset at the twelve o'clock position. The heavy line 15*e* represents that same offset in the three o'clock position. The heavy line 15*f* represents the offset at approximately the 4:30 position. It will be noted that because of the elliptical path there will be variations in speed and torque and also because of this elliptical path the ball will oscillate somewhat in the position between twelve and three o'clock, three and six o'clock, six and nine o'clock, nine and twelve o'clock. In the 15*f* position, it will be observed that the angles $\theta$ and $\pi$ are unequal and the perpendicular to the arm 15*f* indicated at 15*g* is skewed. In other words, the arm oscillates somewhat at the four positions between the twelve, three, six and nine o'clock positions.

This rocking and the variation in torque and speed can be reduced by lengthening the arm as can be accomplished among other ways by truncating the ball at 15*b*. It will be clear that the centerline of the ball 15*a* cannot cross the centerline of the cheeks 16 so long as the ball offset from the rotor head is equal to, or greater than the eccentricity of the rotor head and preferably greater than twice the eccentricity thereof. This assists in smoothing out the variations in torque and speed which have been described above.

Referring to FIGS. 6 and 7, it will be seen that the inner member head 14 is turning to the left, and the inner member head 14*a* is turning to the right. The gear pair of the FIG. 6 type motor would preferably have right-hand threads, while the FIG. 7 type motor would preferably have left-hand threads. This would produce a right-hand eccentricity of the inner member in FIG. 6, and left-hand eccentricity of the inner member in FIG. 7, as indicated by the broken line circles 13*d* and 13*c*, respectively.

Assuming that the Figures represent the situation looking down the hole, the ball 15 will revolve to the left, but the ball 15*a* will only reciprocate and oscillate as it moves around its elliptical path to the right, as shown by the arrows. FIG. 7 therefore depicts a motor accommodating the right-hand turning direction of a conventional bit (as viewed down hole). However, the ball 15, as stated above, will revolve to the left, while its circular path will be to the right as shown on the broken line circle 13*d* of FIG. 6. This revolution of the ball 15 involves no reciprocation or oscillation. The arrangement of FIG. 6 thus also accommodates the conventional bit rotation to the right, and without variation in speed and torque.

It will be understood that in order to keep threads tight, the ball 15 would be attached to the inner member head by means of left-hand threads, while the ball 15*a* would be attached by means of right-hand threads. Also the plate 21 would be attached to the inner member with right-hand threading in FIGS. 1 and 2, and with left-hand threading in FIGS. 3 and 4, for the same reason.

In order to reduce the shock on the system when the ball is caused to re-enter between the cheeks, it is desirable that while the cheek against which the ball presses be vertical, the cheek following behind the ball against which the ball is not bearing, may be sloped so that the shock of the ball entering the cheeks is reduced.

It will be understood that modifications may be made without departing from the spirit of the invention and no limitation which is not expressly set forth in the claims should be implied and no such limitation is intended.

The embodiments of the invention in which an exclusive property or privilege is claimed are defined as follows:

1. In a hydraulic down-hole earth drilling motor of the helical gear pair type, having a transmission from said motor to a drill bit, comprising an extension from the inner helical gear having a socket on the lathe axis thereof, and a ball having a shank secured in said socket, and a half-tube associated with the drill bit and being diametrically disposed with respect to the hole, said ball extending into said half-tube, means for withdrawing said motor and ball to the extent that said ball comes out of engagement with said half-tube to permit fluid to be pumped through said motor for clean-out mud density build-up and like purposes without producing rotation of said bit and its associated parts.

2. The device of claim 1 wherein said ball is disposed on the lathe axis of the inner of said helical gear pair.

3. The device of claim 1 wherein said ball is offset from the lathe axis of the inner of said helical gear pair.

4. The device of claim 1 wherein said half-tube comprises a pair of parallel cheeks spaced to accept said ball therebetween, and a surface connecting said cheeks, against which said ball bears during a drilling operation.

5. The device of claim 1 wherein said half-tube is substantially one half of a cylinder of a size to accommodate said ball.

6. The device of claim 1 wherein said transmission includes a drill shaft terminating in a bit box, radial and thrust bearings for said drill shaft, a retaining ring for said thrust bearings, and a brake ring on said bit box, said retaining ring and brake ring being initially spaced by the amount of bearing wear which can be tolerated, whereby upon such amount of wear, said retaining ring and brake ring come into contact, thereby slowing the motor and causing an increase in pump pressure to warn the operator that the bearings need replacement, and ultimately stalling the motor if drilling is not stopped before the bearings are worn beyond a safe point.

7. The device of claim 1 wherein the drill bit is secured to a bit box, and the transmission from the motor to the drill bit includes a tubular drill shaft, and wherein said drill shaft rotates in a bearing set providing radial and thrust bearings between said drill shaft and the drill string, and a retaining nut is provided to hold said bearing set in place, an annular brake member on said bit box adapted to cooperate with said retaining nut, said retaining nut and brake member being initially spaced by the amount of bearing wear which can be tolerated, whereby upon sufficient wear of the thrust bearings, said retaining nut and brake member come into contact, slowing the motor and causing an increase in pump pressure to warn the operator that the bearings need replacement, and ultimately stalling the motor if drilling is not stopped by the operator before the bearings are worn beyond a safe point.

8. The device of claim 1 wherein said ball, when in driving position within said half-tube never crosses the center of said half-tube, whereby when said motor is lowered to reintroduce said ball into said half-tube, there is a fifty percent chance that it will engage in the other half of the half-tube thereby reducing wear on said half-tube by about fifty percent.

9. The device of claim 1 wherein said motor is secured to a drill string and the disengagement of said ball and half-tube is accomplished by raising the drill string.

10. The device of claim 9 wherein said drill bit is secured to a driving member, and a means of engagement is provided on the inside of said drill string, and a cooperating means of engagement is provided on the outside of said member, said means coming into engagement when said drill string is raised to disengaged position of said ball and half-tube to obtain a conventional drilling mode for drill pipe withdrawal.

11. The device of claim 1 including means to insure that the inner helical gear is raised along with said outer helical gear, and does not slip out of said outer helical gear.

12. The device of claim 11 wherein said last mentioned means comprises a support plate secured in the center of the cross section of the tail end of the inner helical gear member providing optimum over-hang with respect to the end of the outer helical gear member.

* * * * *